US005657038A

United States Patent [19]

Okada et al.

[11] Patent Number: 5,657,038

[45] Date of Patent: Aug. 12, 1997

[54] LIQUID CRYSTAL DISPLAY APPARATUS HAVING SUBSTANTIALLY THE SAME AVERAGE AMOUNT OF TRANSMITTED LIGHT AFTER WHITE RESET AS AFTER BLACK RESET

[75] Inventors: Shinjiro Okada, Isehara; Yutaka Inaba, Kawaguchi; Kazunori Katakura, Atsugi, all of Japan

[73] Assignee: Canon Kabushiki Kaisha, Tokyo, Japan

[21] Appl. No.: 585,753

[22] Filed: Jan. 16, 1996

Related U.S. Application Data

[63] Continuation of Ser. No. 166,874, Dec. 15, 1993, abandoned.

[30] Foreign Application Priority Data

Dec. 21, 1992 [JP] Japan ..... 4-355393

[51] Int. Cl.[6] ..... G09G 3/36

[52] U.S. Cl. ..... 345/94; 345/97

[58] Field of Search ..... 345/89, 94, 101, 345/96, 97, 58, 208, 209, 103, 87; 359/54, 57, 56, 59

[56] References Cited

U.S. PATENT DOCUMENTS

| | | | |
|---|---|---|---|
| 4,367,924 | 1/1983 | Clark et al. | 350/334 |
| 4,563,059 | 1/1986 | Clark et al. | 350/330 |
| 4,639,089 | 1/1987 | Okada et al. | 350/341 |
| 4,655,561 | 4/1987 | Kanbe et al. | 350/350 S |
| 4,681,404 | 7/1987 | Okada et al. | 350/350 S |
| 4,800,382 | 1/1989 | Okada et al. | 340/784 |
| 4,836,656 | 6/1989 | Mouri et al. | 350/350 S |
| 4,902,107 | 2/1990 | Tsuboyama et al. | 350/350 S |
| 4,958,915 | 9/1990 | Okada et al. | 350/345 |
| 5,041,821 | 8/1991 | Onitsuka et al. | 345/101 |
| 5,227,900 | 7/1993 | Inaba et al. | 345/97 |

FOREIGN PATENT DOCUMENTS

| | | |
|---|---|---|
| 56-107216 | 8/1981 | Japan . |
| 63-186215 | 8/1988 | Japan . |

OTHER PUBLICATIONS

Clark et al. "Submicrosecond bistable electro–optic switching in liquid crystals," Applied Physics Letters, vol. 36, No. 11, pp. 899–901 (Jun. 1980).

Clark et al. "Ferroelectric Liquid Crystal Electro–Optics Using the Surface Stabilized Structure," Molecular Crystals and Liquid Crystals, vol. 94, pp. 213–234 (1983).

*Primary Examiner*—Chanh Nguyen

*Attorney, Agent, or Firm*—Fitzpatrick, Cella, Harper & Scinto

[57] ABSTRACT

An LC display device has a circuit for resetting the display status of a scanning line by black resetting and white resetting alternately performed before writing information thereinto. The circuit also modifies a data signal in accordance with the polarity of a reset pulse so as to achieve substantially the same average amount of transmitted light during a period after resetting, regardless of the resetting manners.

2 Claims, 11 Drawing Sheets

V = 0

V < Vth

Vth < V < Vsat

Vsat < V

FIG. 9(a)
PRIOR ART
FIG. 9(b)
PRIOR ART
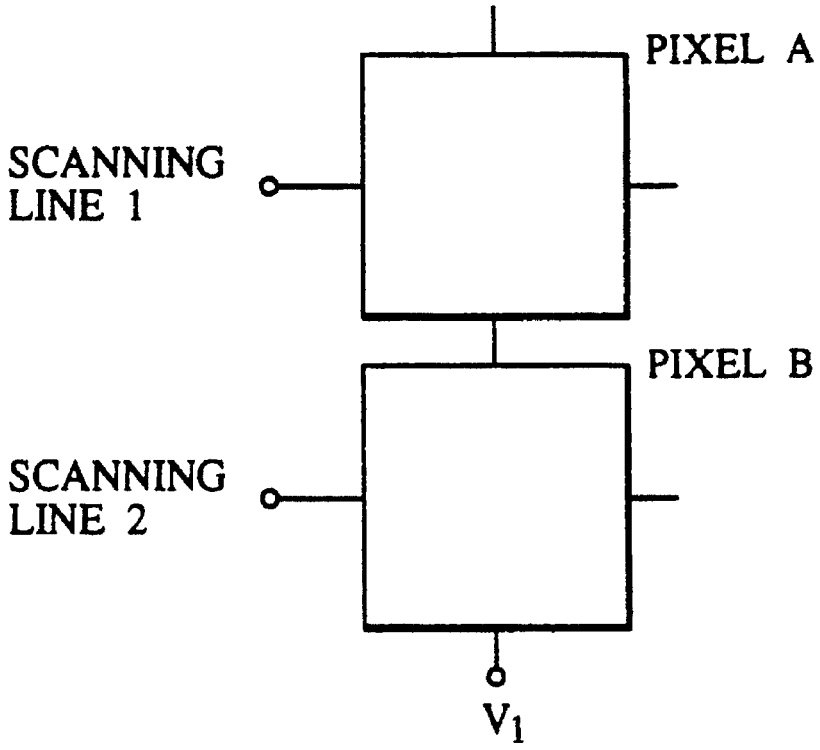
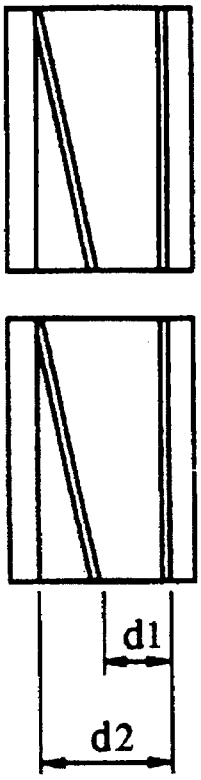

LIQUID CRYSTAL DISPLAY APPARATUS HAVING SUBSTANTIALLY THE SAME AVERAGE AMOUNT OF TRANSMITTED LIGHT AFTER WHITE RESET AS AFTER BLACK RESET

This application is a continuation of application No. 08/166,874 filed Dec. 15, 1993, now abandoned.

BACKGROUND OF THE INVENTION

1. Field of the Invention

The present invention relates to a liquid crystal display device for use in display apparatuses of computer terminals, television receivers, word-processors, typewriters and the like, optical bulbs of projectors, view finders of video cameras, and the like.

2. Description of the Related Art

Various liquid crystal (LC) display devices are known, for example, twisted nematic (TN) LC display devices employing twisted nematic liquid crystals, guest-host LC display devices, and smectic (Sm) LC display devices employing smectic liquid crystals.

In such LC display devices, the liquid crystal sandwiched between substrates changes its transmittance according to the applied voltage. Thus, the strength of the electric field applied thereto varies depending on the size of the inter-substrate gap, that is, the thickness of the liquid crystal layer.

Clark and Lagerwall disclosed a bistable ferroelectric liquid crystal (LC) device employing a surface-stabilized ferroelectric liquid crystal in, for example, Applied Physics Letters, vol. 36, 11 (Jun. 1, 1980), pp. 899–901, Japanese Patent Application Laid-open No. 56-107216, U.S. Pat. Nos. 4,367,924 and 4,563,059. In this bistable ferroelectric LC device, the liquid crystal is disposed in a gap between a pair of substrates arranged so that the gap size is sufficiently small to inhibit the formation of helical structure of the liquid crystal molecules which usually occurs in chiral smectic C phase (SmC) and H phase (SmH) in bulks of the liquid crystals, and homeotropic molecule layers formed of a plurality of LC molecules are aligned in a single direction.

In addition, display devices employing such ferroelectric liquid crystals (FLCs) are also described in U.S. Pat. Nos. 4,639,089, 4,655,561 and 4,681,404. In the display devices, an FLC is filled in a gap of a liquid crystal cell comprising two glass substrates spaced apart from each other by about 1–3 μm, the inside surfaces thereof having been provide with transparent electrodes and alignment-treated.

The above described FLC display devices have the following advantageous features. Because FLCs have spontaneous polarizability, the binding force of spontaneous polarization can be utilized together with an external electric field for switching. Because the directions of the long axes of FLC molecules and the directions of spontaneous polarization show one-to-one correspondence, the FLC display devices can be switched according to the polarity of an external electric field. More specifically, because FLCs in the chiral smectic phase exhibits bistability, that is, they quickly assume one of the first and second optically stable states in response to application of an electric field, and remains in the same optically stable state even after the electric field is discontinued, FLC display devices are expected to be widely employed in various fields, for example, high-speed and memory-type display apparatuses.

As described above, although chiral smectic liquid crystals (SmC, SmH), widely-used FLCs, exhibit in bulk alignments in which the long axes of the liquid crystal molecules are twisted, the twisting of the long axes of liquid crystal molecules is eliminated if such a liquid crystal is filled in a cell gap having a size of about 1–3 μm (N. A. Clark et al, MCLC (1983) vol. 94, pp. 213–234).

A liquid crystal display apparatus comprising an FLC as described above can employ a display panel comprising large-capacity pixels to display images if it uses the multiplexing drive method disclosed by Kanbe et al in, for example, U.S. Pat. No. 4,655,561. Such LC display apparatuses can be used in word processor, personal computers, microprinters, televisions.

Although FLC devices generally use the two stable states to transmit and block light, that is, to perform binary (black and white) display, they can also perform multivalued (gray tone) display. A gray tone display method, called area modulation method, achieves intermediate light transmitting states by controlling the ratio between the areas in the bistable states in a pixel. The area modulation method will be described below.

FIG. 1 is a graph indicating the relation between the transmittance and the amplitude V of a switching pulse in an FLC device. The horizontal axis of the graph is the logarithms of the amplitude V of a single pulse having one polarity, and the vertical axis is the amount I of light transmitted through a cell (device) while the cell changes from the light blocking (black) state to the light transmitting (white) state by application of the single pulse thereto. When the amplitude of the pulse V is less than a threshold $V_{th}$ ($V<V_{th}$), the amount of transmitted light does not increase, that is, the state of the pixel exhibits no change, as shown in FIGS. 2(*a*) and 2(*b*) indicating the states before application of a single pulse and the state immediately after the pulse application, respectively. When the pulse amplitude exceeds the threshold ($V_{th}<V<V_{sat}$), part of the pixel changes from the light blocking state to the light transmitting state, as indicated in FIG. 2(*c*). Thus, the pixel as a whole transmits intermediate amounts of light. When the pulse amplitude becomes greater than the saturated value $V_{sat}$ ($V_{sat}<V$), the entire pixel assumes the light transmitting state as indicated in FIG. 2(*d*). Thus, the amount of transmission reaches a constant value. The area modulation method achieves gray tones by controlling the applied voltage so that the pulse amplitude V becomes a value within the range $V_{th}<V<V_{sat}$.

However, because the amount of light transmission varies depending on the cell thickness and the temperature as well as the applied voltage, such a simple driving method as the area modulation method has a problem in that if the thickness or temperature differs from one location to another in a cell, the tone level of one pixel will be different from that of another pixel even when pulses of the same amplitude (voltage) are applied thereto.

The above-stated problem will be explained with reference to the graph of FIG. 3, similar to FIG. 1, indicating the relation between the amplitude (voltage) V of an applied pulse and the amount I of transmitted light. The lines H and L of the graph indicate the V-I relation at high and low temperatures, respectively. As indicated by the graph, an amplitude $V_{ap}$ of a single pulse gives gray tones varying within the range between $I_1$ and $I_2$ depending on temperature, thus failing to display a uniformly-toned image. Because such a non-uniform temperature distribution in a portion corresponding to a single pulse (a displaying portion) normally occurs, particularly, in a large-size display device, the area modulation method often suffers from this problem.

To eliminate the problem, the present inventors have proposed "4-pulse method" in U.S. patent application No. 681,993 filed on Apr. 8, 1991 (see FIGS. 4 and 5). This driving method applies a plurality of pulses pulses, (A), (B), (C) and (D) as shown in FIGS. 4 and 5) to low, intermediate and high-threshold portions in a single scanning line and thereby achieves substantially the same inverted areas in all the portions when the last pulse, pulse (D) in the aforementioned figures, has been applied.

The present inventors also proposes, in the specification of U.S. patent application No. 984,694 filed on Dec. 2, 1992, "pixel shift method" which requires a shorter write-in time than the 4-pulse method. The pixel shift method simultaneously inputs different scanning signals to a plurality of scanning signal lines and thus selectively obtain a distribution of electric field strength over the scanning lines in order to achieve gray tone display.

The pixel shift method will be briefly described. The LC cell used by the pixel shift method has threshold gradient in each pixel. FIG. 6 shows an example of such an LC cell. As shown in FIG. 6, because the thickness of an FLC layer 55 between the electrodes varies over each pixel, the switching threshold of the FLC accordingly varies over each pixel. If the voltage applied to such pixels is gradually increased, switching (state inversion) gradually occurs from portions having a small FLC thickness to portions having a large FLC thickness.

FIG. 7(*a*) is a graph indicating that the relations between the applied voltage and transmittance at three different temperatures, in which T1, T2 and T3 are the temperatures of a portion of the panel that is observed. As indicated by the graph, the switching threshold of the FLC decreases as temperature increases.

Although factors other than temperature can also cause the threshold to vary, the following description will be made only in connection with variation in temperature, to simplify the description.

As indicated by FIG. 7(*a*), when a voltage $V_i$ is applied at a temperature $T_1$ to a pixel that has been entirely reset to the light-blocking state, the pixel achieves a transmittance of X %. However, if the temperature increases to $T_2$ or $T_3$, the application of the voltage $V_i$ to the pixel will provide a transmittance of 100%, thus failing to achieve a proper gray tone. FIG. 7(*c*) illustrates the status of the black-white inversion in a pixel at the temperatures $T_1$, $T_2$ and $T_3$ after tone data have been written thereinto. Because the effect of tone data significantly varies depending on temperature as shown in FIG. 7(*c*), use of an LC device is limited to a significantly narrow temperature range.

However, stable tone display can be achieved despite temperature variation by employing the pixel shift method in which, as shown in FIG. 7(*d*), data for a pixel is shared by two adjacent pixels on different scanning signal lines S1 and S2.

This driving method will be described below in connection with three major features.

(1) The method uses an FLC cell having a continuously -varying threshold distribution in each pixel, for example: an FLC cell as shown in FIG. 6 in which each pixel has a continuously varying cell-thickness distribution; an FLC cell, as proposed by the present applicant in Japanese Patent Application Laid-open No. 63-186215, in which each pixel has potential gradient; or an FLC cell in which each pixel has capacity gradient. Because each pixel has a continuously varying threshold distribution, it can simultaneously have a light domain corresponding to the light transmitting state and a dark domain corresponding to the light blocking state. Thus, tone display can be achieved by controlling the area ratio of the light and dark domains.

This driving method can be employed to achieve stepwise tone display and continuous (analog) tone display. To achieve analog tone display, the amount of light transmitted through each pixel must be continuously varied.

(2) The pixel shift method simultaneously selects two scanning signal lines. This feature will be described with reference to FIGS. 8(*a*) and 8(*b*). FIG. 8(*a*) is a graph indicating the transmittance-voltage characteristic when two adjacent pixels on neighboring scanning signal lines are used in combination. In the graph, the transmittance range of 0–100% is assigned to indicate a display domain of a pixel B on a scanning line 2, and the transmittance range of 100–200% is assigned to indicate a display domain of a pixel A on a scanning line 1. In short, the transmittance 200% means that two adjacent pixels A and B have entirely assumed the light. transmitting state when the two adjacent scanning signal lines 1 and 2 are scanned. According to this method, two scanning signal lines are simultaneously selected in response to a piece of tone data, and a domain as large as one pixel is assigned for the piece of data, as illustrated in FIG. 8(*b*).

At temperature T1, tone data is written in as follows. The applied voltage $V_0$ inverts an area corresponding to transmittance 0%, and the applied voltage $V_{100}$ inverts an area corresponding to transmittance 100% thereof. In other words, at temperature $T_1$, the area which undergoes stable state inversion when receiving voltage ranging from $V_0$ to $V_{100}$ (hereinafter, referred to as "the effective pixel area") coincides with the area consisting of the pixels B on the scanning signal line 2, as indicated by the shadowed area in FIG. 8(*b*).

If the temperature rises from $T_1$ to, for example, $T_2$, the threshold voltage of the liquid crystal accordingly decreases and, therefore, an area inverted (or a light transmitting domain achieved) by the same level of voltage will increase. To correct such a temperature-dependent increase of the inverted area, presetting is made so that the effective pixel area is shifted so as to lie over the pixels A and B on the scanning lines 1 and 2 without a substantial change in size, as indicated by the shadowed area associated with "$T_2$°C." in FIG. 8(*b*).

If the temperature further rises to $T_3$, the effective pixel area is shifted so as to coincide with the area consisting of the pixels A on the scanning signal line 1, as indicated by the shadowed area associated with "$T_3$°C." in FIG. 8(*b*).

(3) The pixel shift method applies different scanning signals to the two scanning lines simultaneously selected. To compensate for temperature-dependent variation in the threshold voltage for LC state switching by simultaneously selecting two scanning signal lines, the scanning signals applied to the two scanning signal lines must be different from each other. This feature will be described with reference to FIGS. 7(*a*) to 7(*d*).

The scanning signals applied to the scanning lines 1 and 2 are formed so that the switching threshold continuously varies from the pixels B on the scanning signal line 2 to the pixels A on the scanning signal line 1, that is, as shown in the graph of FIG. 7(*b*), a transmittance-voltage line is linear and continuous from the pixels A to the pixels B. Like the graph of FIG. 8(*a*), the graph of FIG. 7(*a*) indicates that it the transmittance is within the range of 0–100%, only the pixels B on the scanning signal line 2 are used for display, and that, if it is within the range of 100–200% the pixels A on the scanning signal line 1 are also used for display.

Thereby, even if the pixels A and the pixels B have the same cell shape as illustrated in FIG. 9(*b*), they can perform tone display comparable to the tone display performed by a cell, as shown in FIG. 7(*b*), actually having a switching threshold gradient substantially continuous from the pixels B to the pixels A.

If the pixel shift method is employed to perform tone display, it is preferable that the erasing (reset) orientation be switched every scanning line or every frame. However, because the cycle of reset to the light transmitting state (white reset) and reset to the light blocking state (black reset) causes a light quantity change during the resetting period or after the write-in period, a viewer may perceive flickering of the display.

In addition to the above problem, there is another problem. Even when the same tone level needs to be maintained, the tone level after white reset and the tone level after black reset differ from each other due to light leaking during reset periods or after write-in periods.

SUMMARY OF THE INVENTION

Accordingly, an object of the present invention is to provide a liquid crystal display apparatus which improves contrast during tone display driving by modifying the content of display information so as to achieve substantially the same average amount of transmitted light of a frame after white reset and a frame after black reset.

One aspect of the present invention provides a liquid crystal display apparatus of matrix-electrode type for performing tone display comprising: two electrode substrates spaced from each other so as to form a gap therebetween, each of the electrode substrates having an electrode extending in a direction different from the direction of the electrode of the other electrode substrate so as to substantially intersect the other electrode; a ferroelectric liquid crystal filled in the gap, whereby a pixel is formed in an intersection portion of the ferroelectric liquid crystal at which the electrodes of the two electrode substrates substantially intersect, the pixel having a non-uniform threshold distribution; and a circuit for performing entire-frame writing by line sequential scanning whereby the display status of each scanning line portion is reset before information is written into the scanning line portion, and for modifying an information signal in accordance with the polarity of a reset pulse so as to achieve substantially the same average amount of transmitted light during a period in a frame after resetting by "white" orientation and during a period in a frame after resetting by "black" orientation.

Another aspect of the present invention provides a liquid crystal display device for performing display comprising: a liquid crystal; matrix electrodes including a plurality of scanning electrodes and a plurality of information electrodes which are used to apply a voltage to the liquid crystal; driving means for applying to the liquid crystal a reset signal having a polarity and a write-in signal having the opposite polarity, and for inverting the polarity of the reset signal and the polarity of the write-in signal every predetermined scanning period of time; and means for providing the pixel with different transmittances corresponding to the polarity of the reset signal in order to achieve a desired display status of the pixel.

Further objects, features and advantages of the present invention will become apparent from the following description of the preferred embodiments with reference to the attached drawings.

BRIEF DESCRIPTION OF THE DRAWINGS

FIGS. 9(*a*) and (*b*) also illustrates the pixel shift method.

DESCRIPTION OF THE PREFERRED EMBODIMENTS

The operation of the liquid crystal display device of the present invention will be first described with reference to FIG. 10.

Figure 10:
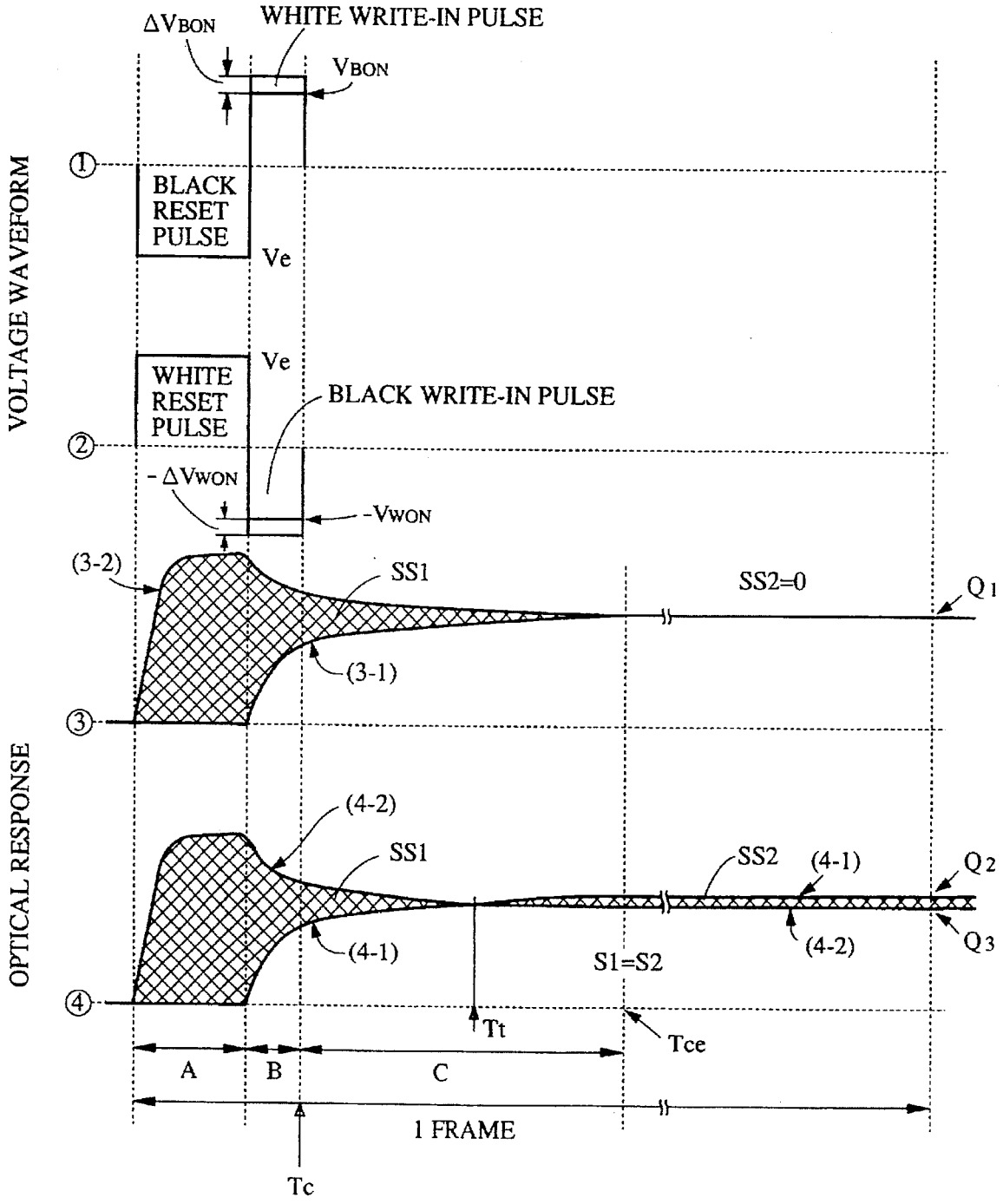
FIG. 10 illustrates the operation of the LC display device of the present invention.

FIG. 10 illustrates waveforms 1 and 2 which are applied to pixels. The waveform 1 is essentially composed of a black reset pulse for resetting a pixel to the light blocking state and a white write-in pulse of a voltage $V_{BON}$ for writing a display data into the pixel so as to orient LC molecules therein to the light transmitting state. The waveform 2 is essentially composed of a white reset pulse for resetting a pixel to the light transmitting state and a black write-in pulse of a voltage $-V_{WON}$ for writing a display data into the pixel so as to orient LC molecules therein to the light blocking state.

FIG. 10 further shows the curves (3-1) and (3-2) indicating the patterns of optical response of a pixel to the waveforms 1 and 2, respectively, in graph 3 where the vertical axis is the quantity of light and the horizontal axis is time. The integration of light quantity difference between the curves (3-1) and (3-2) over time corresponds to the area enclosed by the two curves (3-1) and (3-2) (the shadowed area).

The amount of light quantity difference (corresponding to the area between the optical response curves) that adversely affects the tone level varies depending on the time length of a frame, the length of a lingering period C, and the length of the total A+B of an erasing (resetting) period A and a write-in period B. Further, it is significantly dependent on the number of tones used for display. For example, if 8 tones are used, the light quantity difference corresponding to the area SS1 may be up to 12.5%. On the other hand, if 256 tones are used, it must be as small as 0.39% or smaller.

The "area SS1" is an area within the range of the period A+B+C starting at the erasing start timing, the area excluding an area where the optical response curve (3-2) or (4-2) is below the optical response curve (3-1) or (4-1). In addition, the area where the optical response curve (3-2) or (4-2) is below the optical response curve (3-1) or (4-1) is referred to as "area SS2".

To eliminate the adverse effect on tone level caused by the light quantity difference, the amount of white write-in 10 following a black reset and the amount of black write-in following a white reset with respect to the same information to be displayed are determined so as to equalize the integrated light quantities following the white write-in and the black write-in in the frames. More specifically, as indicated by the graph 4 of FIG. 10, the light quantity achieved by the white write-in pulse following a black reset pulse (4-1) is increased and the light quantity achieved by the black write-in pulse following a white reset pulse (4-2) is reduced so that the areas SS1 and SS2, excluding periods A and B, become equal, that is, the integrated light quantity over a period in a frame excluding the erasing and writing-in periods A and B is maintained at the same level despite the different erasing and writing-in manners. The fluctuation of tone level can be thus eliminated or reduced.

According to the conventional art, the write-in pulses $V_{BON}$ and $-V_{WON}$ are determined so that the light quantity after lingering end timing Tce becomes a target value $Q_1$. On the other hand, according to the present invention, the white write-in pulse $V_{BON}$ following the black reset is corrected with a correction $\Delta V_{BON}$ to a pulse height $V_{BON}+\Delta V_{BON}$ so as to provide a light quantity $Q_2$ ($Q_2>Q_1$) after the lingering end timing Tce.

In stead of increasing the pulse height, the pulse width B may be increased by a correction ΔB so as to provide the light quantity $Q_2$ ($Q_2>Q_1$) after the lingering end timing Tce.

Further, instead of correcting the white-in pulse $V_{BON}$, the black write-in pulse $-V_{WON}$ following the white rest may be corrected with a correction $-\Delta V_{WON}$ to $-V_{WON}-\Delta V_{WON}$ so as to provide a light quantity $Q_3$ ($Q_1>Q_3$) after the lingering end timing Tce.

Naturally, the width B of the black write-in pulse may be increased by a correction ΔB so as to provide the light quantity $Q_3$ ($Q_1>Q_3$) after the lingering end timing Tce.

Still further, any combination of the above correction methods may be employed. For example, both the white and black write-in pulses are corrected so as to provide light quantities $Q_2$ and $Q_3$ ($Q_2>Q_1>Q_3$) after the lingering end timing Tce.

It may be conceived that a shift from the target light quantity $Q_1$ $|Q_1-Q_2|$ or $|Q_1-Q_3|$ would adversely affect images. However, according to experiments, the present inventors have confirmed that because the light quantity differences SS1 and SS2 after resetting and writing-in in individual frames offset each other, the quality of images is considerably enhanced instead.

Even if, in a matrix-driven (multiplexing-driven) LC device, substantial reduction of the light quantity difference SS1 is impeded by the parasitic capacity or parasitic resistance of the pixels which increase as the pixels are further miniaturized and highly packed, the LC display device of the present invention can enhance the apparent quality of images.

It is preferable to determine a correction light quantity S2 as follows.

The light quantity Sn ($0\leq n\leq N$) through a pixel integrated over the period of one frame when the nth tone is displayed is:

$$Sn=(S_W-S_B)n.1/N+S_B$$

where $S_W$ is the integrated light quantity through a pixel over the period of a frame when the pixel is entirely white (the state that allows the pixel to transmit the maximum light quantity); $S_B$ is the integrated light quantity through a pixel over the period of a frame when the pixel is entirely black (the state that allows the pixel to transmit the minimum light quantity); N is the number of tones to be display; and n is the serial number of a tone.

The light quantity difference $\Delta S_N$ between two consecutive tones of the N tones over the period of a frame is:

$$\Delta S_N=(S_W-S_B).1/N$$

Therefore, if $|SS1-SS2|<\Delta S_N$, then good display can be achieved. Preferably, $|SS1-SS2|<\Delta S_N/2$, and more preferably, $|SS1-SS2|<\Delta S_N/4$.

The pulse width or height of a write-in pulse is corrected with a correction so as to obtain the desired value of $Q_2$, $Q_3$ or the intersection Tt of the two optical response curves in the lingering period C and thereby minimize the light quantity difference |SS1–SS2|. The light quantity difference SS2 preferably reduced to 1.6% or less in terms of integrated transmittance (average transmittance in a frame).

Although the present invention has been described in connection with a multiplexing-driven LC display device which inverses the write-in (reset) orientation every frame period, the present invention can be suitably applied to an LC display device which performs 1-H inversion, that is, inverses the write-in (reset) orientation every horizontal scanning period, or an LC display device which performs 1-Fd inversion, that is, inverses the write-in (reset) orientation every field scanning period. In a more preferable mode, a combination of some of the above inversion methods is employed, for example, the combination of the 1-H inversion and the 1-Fd inversion or the combination of the 1-H inversion and the 1-Fm (1-frame) inversion, thereby prolonging the service life of the LC.

Figure 11:
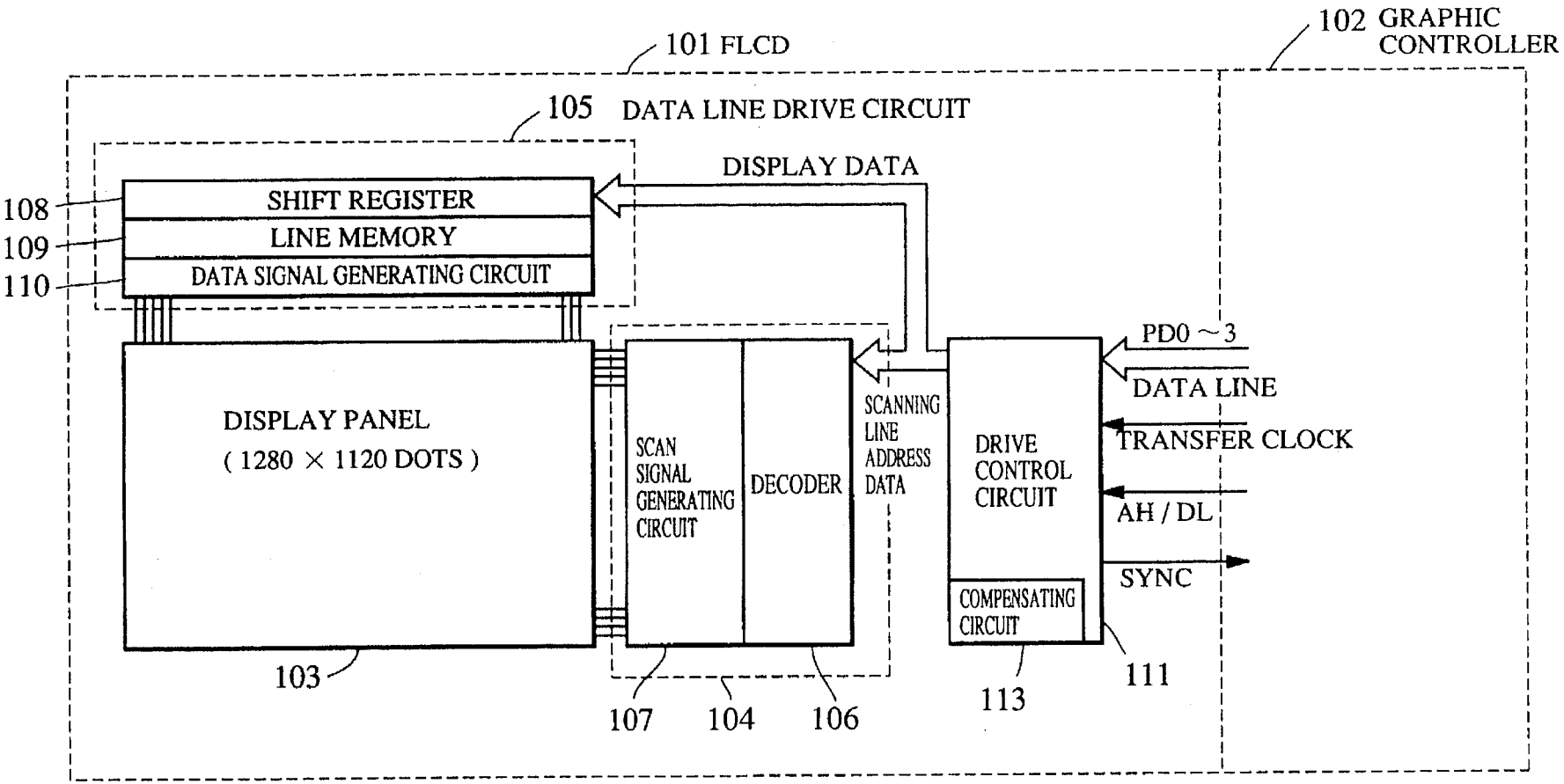
FIG. 11 is a block diagram of a driving circuit suitable for the LC display device of the present invention.
Figure 12:
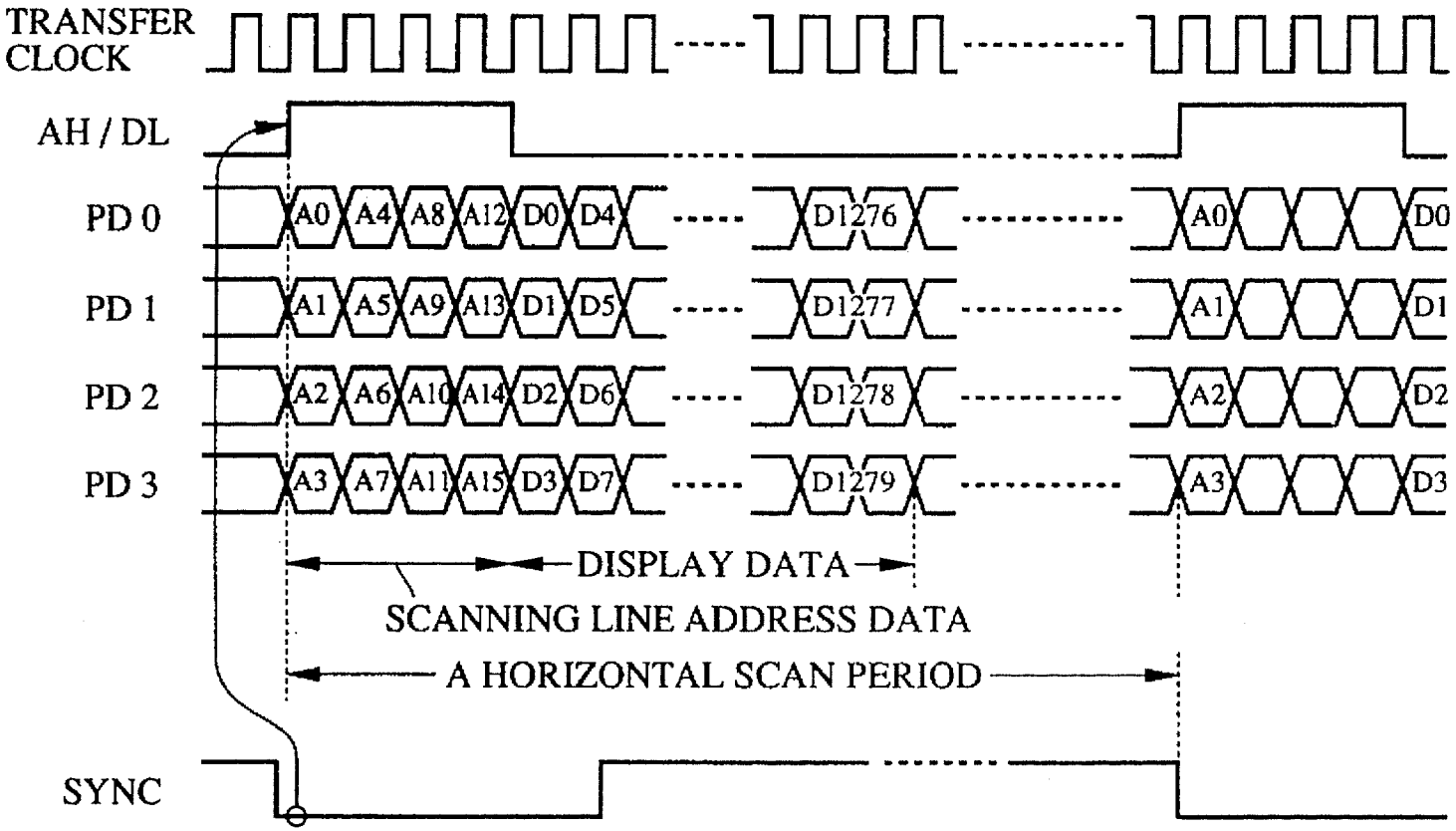
FIG. 12 is a timing chart illustrating the driving circuit.

An embodiment of the LC device of the present invention will be described with reference to FIGS. 11 and 12. FIG. 11 is a block diagram of the LC display device of the present invention. FIG. 12 is a timing chart of image data communication according to the present invention.

A graphic controller 102 transfers image data PD0 to PD3 - including scanning line address data for designating scanning electrodes and display data to be written into the scanning lines designated by the scanning line address data, to an FLC display apparatus 101, more specifically, to a display driving circuit 104/105 composed of a scanning line drive circuit 104 and a data line drive circuit 105.

Because this embodiment uses a single transmission line to transfer image data including scanning line address data and display data, an AH/DL signal is employed to identify the two types of data. The AH/DL is set at two levels, that is, HI level and LOW level. The HI level of the AH/DL signal corresponds to scanning line address data, and the LOW level corresponds to display data.

The scanning line address data are extracted from the image data (PD0–PD3) by a drive control circuit 111 provided in the FLC display apparatus 101, and then outputted therefrom to the scanning line drive circuit 104 in accordance with the timing of driving the designated scanning line. The scanning line address data is inputted to a decoder 106 provided in the scanning line drive circuit 104. Then, a scanning signal generating circuit 107 drives one of the scanning electrodes of a display panel 103 designated by the decoded scanning line address data.

On the other hand, the display data is inputted to a shift register 108 provided in the data line drive circuit 105, where the display data is shifted in units of 4 pixels with reference to a transfer clock. After shifting one horizontal scanning line of display data, that is, display data for 1280 pixels, the shift register 108 outputs the shifted display data to a line memory 109 provided adjacent thereto. The line memory 109 stores the display data during the horizontal scanning period, and an image data generating circuit 110 outputs the data in the form of display data signals to the corresponding information electrodes.

Further, in this embodiment, the generation of scanning line address data and display data by the graphic controller 102 is non-synchronous with driving of the display panel 103 by the FLC display apparatus 101. Therefore, this embodiment uses a synchronization (SYNC) signal to synchronize or determine suitable timing of image data transfer from the graphic controller 102 to the FLC display apparatus 101. The SYNC signal is generated by the drive control circuit 111 of the FLC display apparatus 101 every horizontal scanning period. The graphic controller 102 constantly monitors the SYNC signal. When the SYNC signal is at LOW level, the graphic controller 102 transfers image data to the FLC display apparatus 101. When the SYNC signal is at HI level, the graphic controller 102 transfers no image data thereto after transferring image data for a horizontal scanning line. More specifically, immediately after the graphic controller 102 detects switching of the SYNC signal to LOW level, it switches the AH/DL signal to HI level and starts transferring the image data for a horizontal scanning line. During the transfer of image data, the drive control circuit 111 of the FLC display apparatus 101 switches the SYNC signal to HI level. After a predetermined horizontal scanning period, that is, when the display data has been written into the display panel 103, the drive control circuit (FLCD controller) 111 switches the SYNC signal back to LOW level to receive image data for the next horizontal scanning line from the graphic controller 102.

In this embodiment, a compensating circuit 113, that is, light quantity compensating means according to the present invention, is provided in the drive control circuit 111, as shown in FIG. 11.

The compensating circuit 113 in this embodiment contains a detector circuit for detecting the reset orientation of the pixels of a scanning line selected based on the scanning line address data. In accordance with the detection result outputted by the detector circuit, the compensating circuit 113 adds a correction value (an offset value such as $\Delta V_{BON}$, $\Delta V_{WON}$ or $\Delta B$ as mentioned above) to display data D0 to D1279.

Such light quantity compensation can also be performed by other methods.

In one method, the drive control circuit 111 selectively supplies to the data signal generating circuit 110 a reference voltage for correction (for example, $\Delta V_{BON}$ or $\Delta V_{WON}$) in accordance with the reset orientation, and the data signal generating circuit 110 thereby generates corrected data signals.

Another method adds a correction to a write-in signal component of a scanning signal instead of compensating a data signal.

EXAMPLE 1

A liquid crystal cell having a sectional shape as illustrated in FIG. 10 was produced as Example 1. A lower substrate having a sectional shape like saw teeth was formed by filling an acrylic UV-curing resin 52 in a mold having a saw-tooth like shape and fixing the molded resin 52 to a glass substrate 53.

An ITO film was sputter-formed into stripe electrodes 51 on the saw-tooth like surface of the UV-curing resin 52. Then, an alignment film 54 having a thickness of about 300 Å was formed thereon by using an alignment film (LQ-1802, Hitachi Chemical).

Similarly, the counter (upper) substrate also has stripe electrodes 51 formed thereon and an alignment film formed on the stripe electrode 51. However, the counter (upper) substrate was provided with flat surfaces, not a washboard-like surface.

Rubbing was performed in one direction on each of the upper and lower substrates. The cell was composed so that the rubbing direction of the lower substrate was deviated about 6° clockwise from the rubbing direction of the upper substrate. The cell (LC) thickness was controlled so that thin portions of the LC had a thickness of about 1.0 μm and thick portions had a thickness of about 1.4 μm. The stripe electrodes 51 were patterned along the grooves of the lower substrate so that a width of each inclines surface corresponding to a side of a saw tooth become one of the sides of a pixel. The stripe electrodes 51 were formed so that the width of each stripe 51 was 300 μm. Each pixel was formed in the shape of a rectangular of 300 μm×200 μm.

A liquid crystal as shown in Table 1 was used.

TABLE 1

| Liquid Crystal | |
|---|---|
| Iso ⇄ (82.3° C. / 81.8° C.) Ch ⇄ (76.6° C. / 77.3° C.) SmA* ⇄ (54.8° C.) SmC* | |
| SmC* ⇄ (−2.5° C. / −20.9° C.) Cryst | |
| $Ps = 5.8\ nC/cm^2$, $Ps < 0$ | 30° C. |
| Tilt angle = 14.3° | 30° C. |
| $\Delta\epsilon$—0 | 30° C. |

The threshold of this LC was 11.5 volt/μm (a pulse of 80 μS, at 25° C.). The threshold of each pixel was 11.5–16.1 volt (a pulse of 80 μS, at 25° C.).

Figure 13:
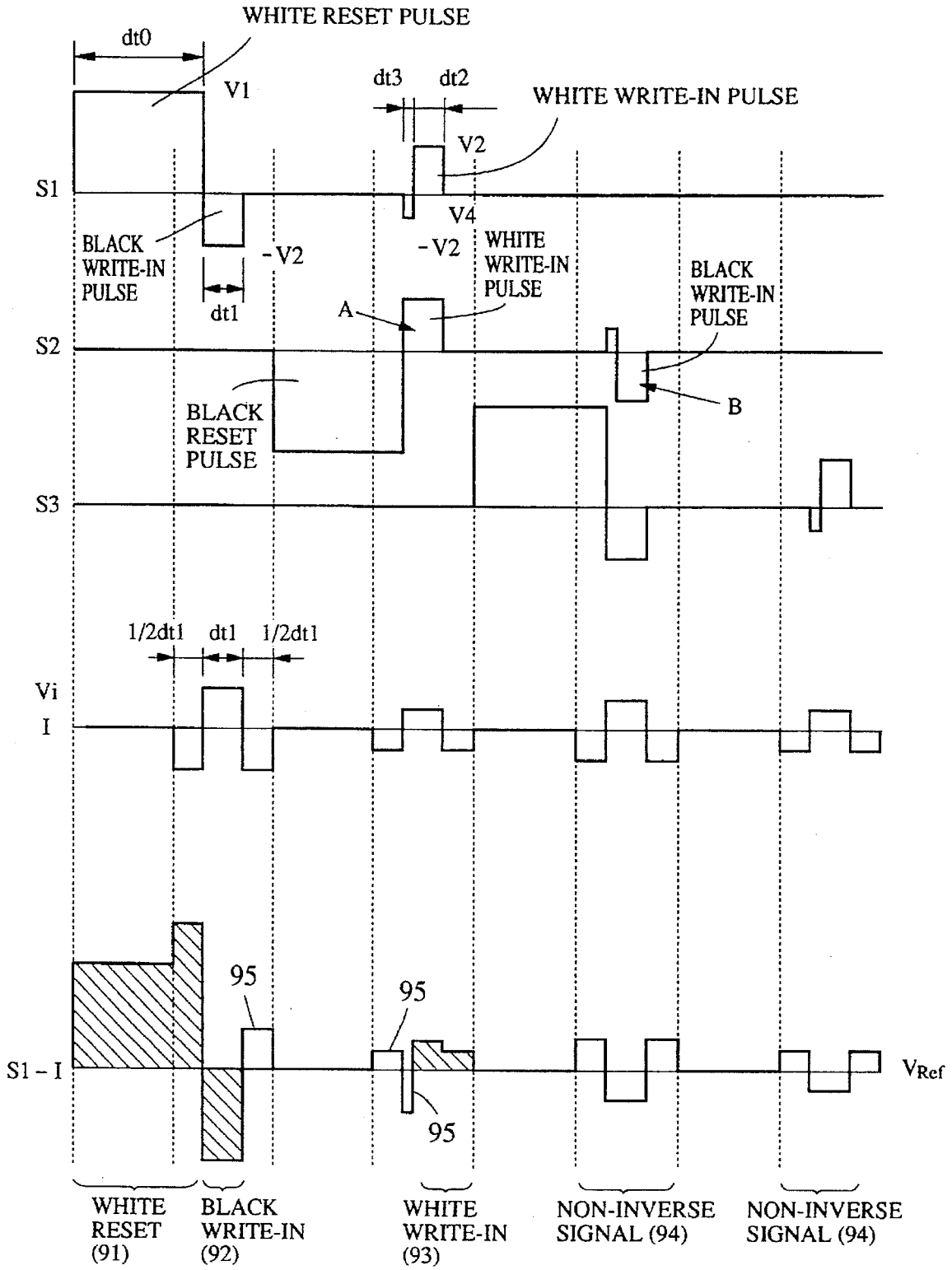
FIG. 13 illustrates the driving waveforms used by Example 1 of the present invention.

Signals having waveforms as shown in FIG. 13 were used to display images on an LC display panel employing the LC cell 25 produced as described above.

FIG. 13 illustrates: scanning signals S1, S2 and S3 applied to three adjacent scanning lines; a data signal I applied to a data line; and a drive signal (electric field) S1-I applied to the LC in the pixel at the crossing position where a scanning line receiving the scanning signal S1 substantially intersects, that is, crosses over, an information line receiving the data signal I.

The drive signal S1-I causes the pixel to display an intermediate tone X. The polarity of the drive signal is inverted every horizontal scanning period. More specifically, the waveform of the drive signal for providing the intermediate tone X on the next scanning line is substantially the symmetrical inversion of the waveform S1-I about the line of reference voltage $V_{Ref}$.

The drive signal S1-I includes a reset signal 91, a first write-in signal 92, a second write-in signal 93, non-inverse signals 94, auxiliary signals 95. The combination of the first and second write-in signals 92, 93 determines a tone to be displayed. The non-inverse signals 92, 93 are data signals that are applied to the data line when other scanning lines (S2, S3) are selected. The non-inverse signals 92, 93 do not substantially change the display status of the LC in the pixel. The auxiliary signals 95 are applied, when necessary, so as to inhibit the application of a DC voltage component to the LC. The auxiliary signals 95 have substantially no effect on display.

To perform tone display by using drive waveforms as shown in FIG. 13, the write-in amounts were determined as follows.

Because the transmission light quantity achieved by X %-tone writing-in after white resetting was about 1.0-point greater than the transmission light quantity achieved by X %-tone writing-in after black resetting, the write-in level after white resetting was corrected to (X−1) %.

Such correction of tone signals enhanced the display quality as discussed above.

The parameters shown in FIG. 13 were determined as follows:

|V1|=20.0 V, |V1|=17.2 V, |Vi|=3.4 to −3.4 V, |V3|=4 V, dt1=40 μS, dt2=27 μS, and dt3=13 μS.

The above parameters were determined so as to achieve transmittances of 0% and 100% in response to the applied voltages of 13.8 V and 20.6 V, respectively, and intermediate tones in response to voltages therebetween, when the voltage modulation method was employed to perform tone display.

Because the above example is an example application of the present invention to the tone display according to the above-described pixel shift method, it used complex waveforms. However, a principal feature of the present invention is to correct the wave height or pulse width of a write-in voltage so as to provide a transmittance difference (SS2) between a period after black resetting and a period after white resetting even when the same tone data is written in.

In this specification, "black (or light blocking state)" and "white (or light transmitting state)" are correspond to "dark (or light blocking state)" and "light (or light transmitting state)" of a liquid crystal cell having a polarizer. Therefore, "black (or light blocking state)" and "white (or light transmitting state)" are inverted if the polarizer is accordingly shifted.

As understood from the above description, the liquid crystal display device of the present invention achieves stable tone display regardless of the erasing (resetting) orientations.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid crystal display apparatus of matrix-electrode type for performing tone display comprising:

a) two electrode substrates spaced from each other so as to form a gap therebetween, each of said electrode substrates having an electrode extending in a direction different from the direction of the electrode of the other electrode substrate so as to substantially intersect the other electrode;

b) a ferroelectric liquid crystal filled in the gap, whereby a pixel is formed in an intersection portion of said ferroelectric liquid crystal at which the electrodes of said two electrode substrates substantially intersect, the pixel having a non-uniform threshold distribution;

c) driving means for applying to said liquid crystal a reset signal having a polarity and a write-in signal having an opposite polarity, and for inverting the polarity of the reset signal and the polarity of the write-in signal every predetermined scanning period of time; and d) compensating means for compensating the write-in signal, so that a first optical response curve corresponding to a reset signal having the polarity and a subsequent write-in signal having the opposite polarity and a second optical response curve corresponding to a reset signal having the opposite polarity and a subsequent write-in signal having the polarity intersect in a frame, wherein the intersection occurs within a lingering period and wherein the compensating means compensates such that a difference |SS1−SS2| is reduced, where SS1 equals the integration of a light quantity defined by the difference between said first and second optical response curves before the intersection occurs, and after the write-in-signal, in the frame and SS2 equals the integration of the light quantity difference between said first and second optical response curves after the intersection occurs.

2. A liquid crystal display device for performing display comprising:

a) a liquid crystal;

b) matrix electrodes including a plurality of scanning electrodes and a plurality of information electrodes which are used to apply a voltage to said liquid crystal;

c) driving means for applying to said liquid crystal a reset signal having a polarity and a write-in signal having an opposite polarity, and for inverting the polarity of the reset signal and the polarity of the write-in signal every predetermined scanning period of time; and d) compensating means for compensating the write-in signal, so that a first optical response curve corresponding to a reset signal having the polarity and a subsequent write-in signal having the opposite polarity and a second optical response curve corresponding to a reset signal having the opposite polarity and a subsequent write-in signal having the polarity intersect in a frame wherein the intersection occurs within a lingering period and wherein the compensating means compensates such that a difference |SS1−SS2| is reduced, where SS1 equals the integration of a light quantity defined by the difference between said first and second optical response curves before the intersection occurs, and after the write-in signal, in the frame and SS2 equals the integration of the light quantity difference between said first and second optical response curves after the intersection occurs.

* * * * *

UNITED STATES PATENT AND TRADEMARK OFFICE

CERTIFICATE OF CORRECTION

PATENT NO. : 5,657,038

DATED : August 12, 1997

INVENTOR(S): SHINJIRO OKADA ET AL.

It is certified that error appears in the above-identified patent and that said Letters Patent is hereby corrected as shown below:

COLUMN 1

Line 47, "provide" should read --provided--;
Line 58, "exhibits" should read --exhibit--;
Line 61, "remains" should read --remain--.

COLUMN 2

Line 11, "processor," should read --processors,--.

COLUMN 3

Line 5, "5)" should read --5--;
Line 10, "proposes," should read --propose,--;
Line 15, "obtain" should read --obtains--;
Line 30, "T1, T2 and T3" should read --$T_1$, $T_2$ and $T_3$--;
Line 59, "-varying" should read --varying--.

COLUMN 4

Line 18, "light." should read --light--;
Line 24, "temperature T1," should read --temperature $T_1$,--;
Line 63, "it" should read --if--;
Line 66, "100-200%" should read --100-200%,--.

COLUMN 5

Line 65, "20" should be deleted.

COLUMN 6

Line 15, "illustrates" should read --illustrate--;
Line 67, "10" should be deleted.

UNITED STATES PATENT AND TRADEMARK OFFICE

CERTIFICATE OF CORRECTION

PATENT NO. : 5,657,038

DATED : August 12, 1997

INVENTOR(S): SHINJIRO OKADA ET AL.

It is certified that error appears in the above-identified patent and that said Letters Patent is hereby corrected as shown below:

COLUMN 7

Line 24, "In stead" should read --Instead--;
Line 27, "white-in" should read --write-in--;
Line 28, "rest" should read --reset--.

COLUMN 8

Line 2, "display;" should read --displayed;--;
Line 16, "SS2" should read --SS2 is--;
Line 23, "inverses" should read --inverts--;
Line 25, "inverses" should read --inverts--;
Line 38, "-including" should read --including--.

COLUMN 10

Figure 1:
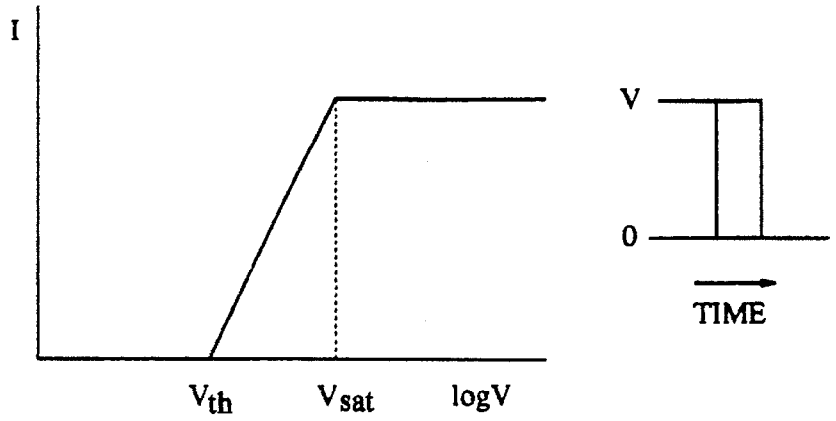
FIG. 1 PRIOR ART
FIG. 1 schematically illustrates the relation between the 20 transmittance of an FLC and the voltage applied thereto in a conventional FLC device employing the area modulation method.
Figure 2A:
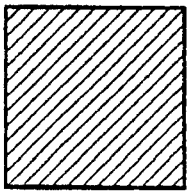
FIG. 2(a) PRIOR ART
FIGS. 2(*a*) to 2(*d*) illustrate the stable state inversion of a pixel in accordance with the voltage applied thereto in a conventional area modulation FLC device.
Figure 2B:
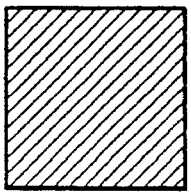
FIG. 2(b) PRIOR ART
Figure 2C:
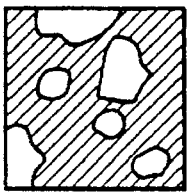
FIG. 2(c) PRIOR ART
Figure 2D:
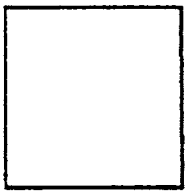
FIG. 2(d) PRIOR ART
Figure 3:
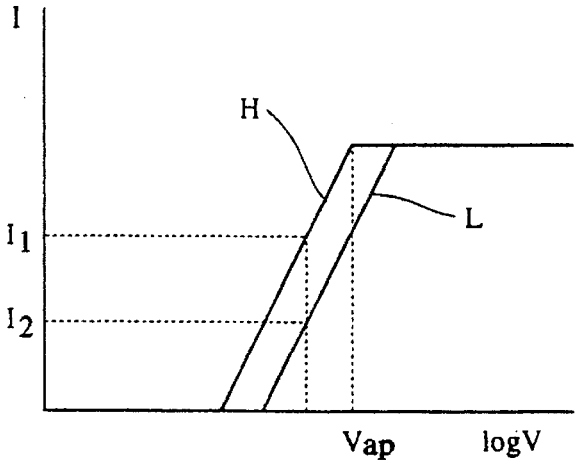
FIG. 3 PRIOR ART
FIG. 3 is a graph indicating the relation between the transmittance of an FLC and the voltage applied thereto at different temperatures.
Figure 4:
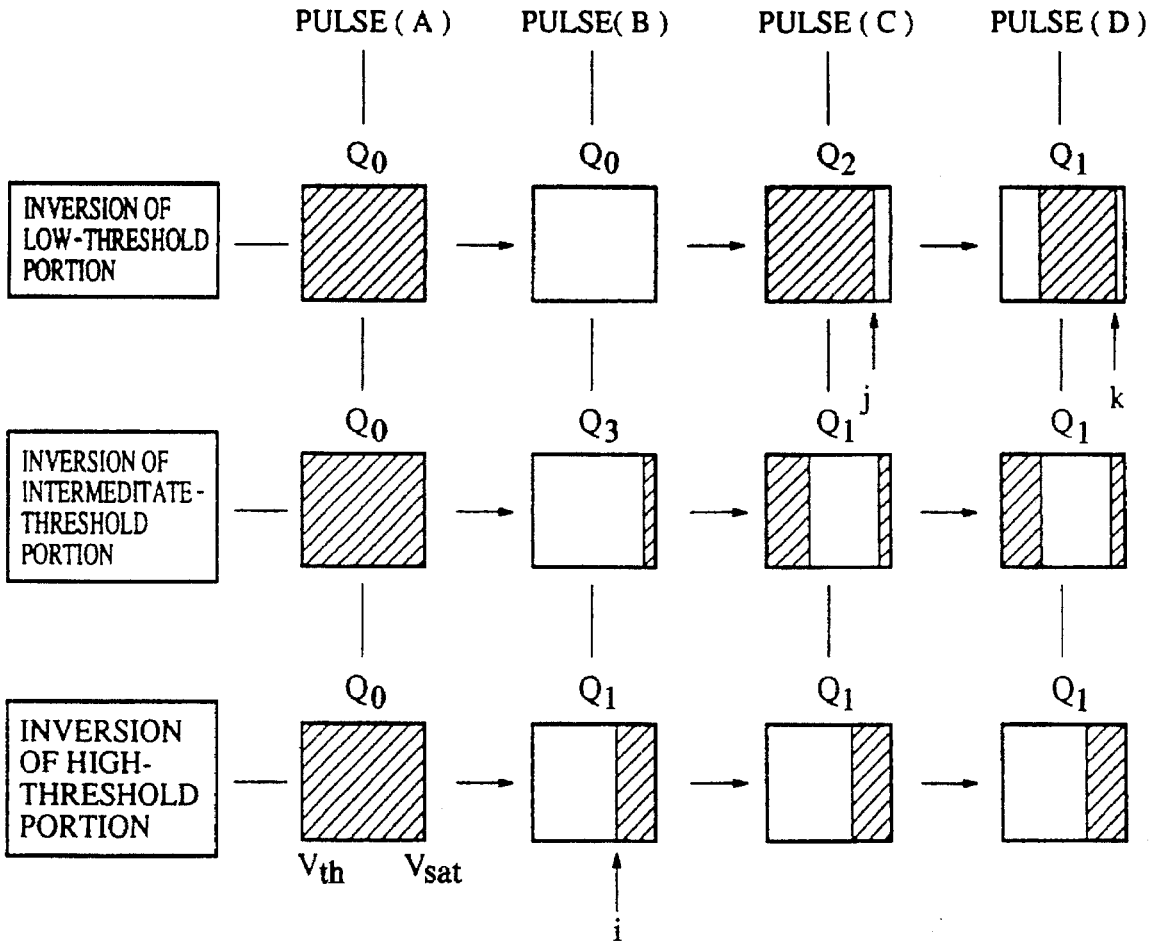
FIG. 4 PRIOR ART
FIG. 4 illustrates a conventional driving method, that is, the 4-pulse method.
Figure 5:
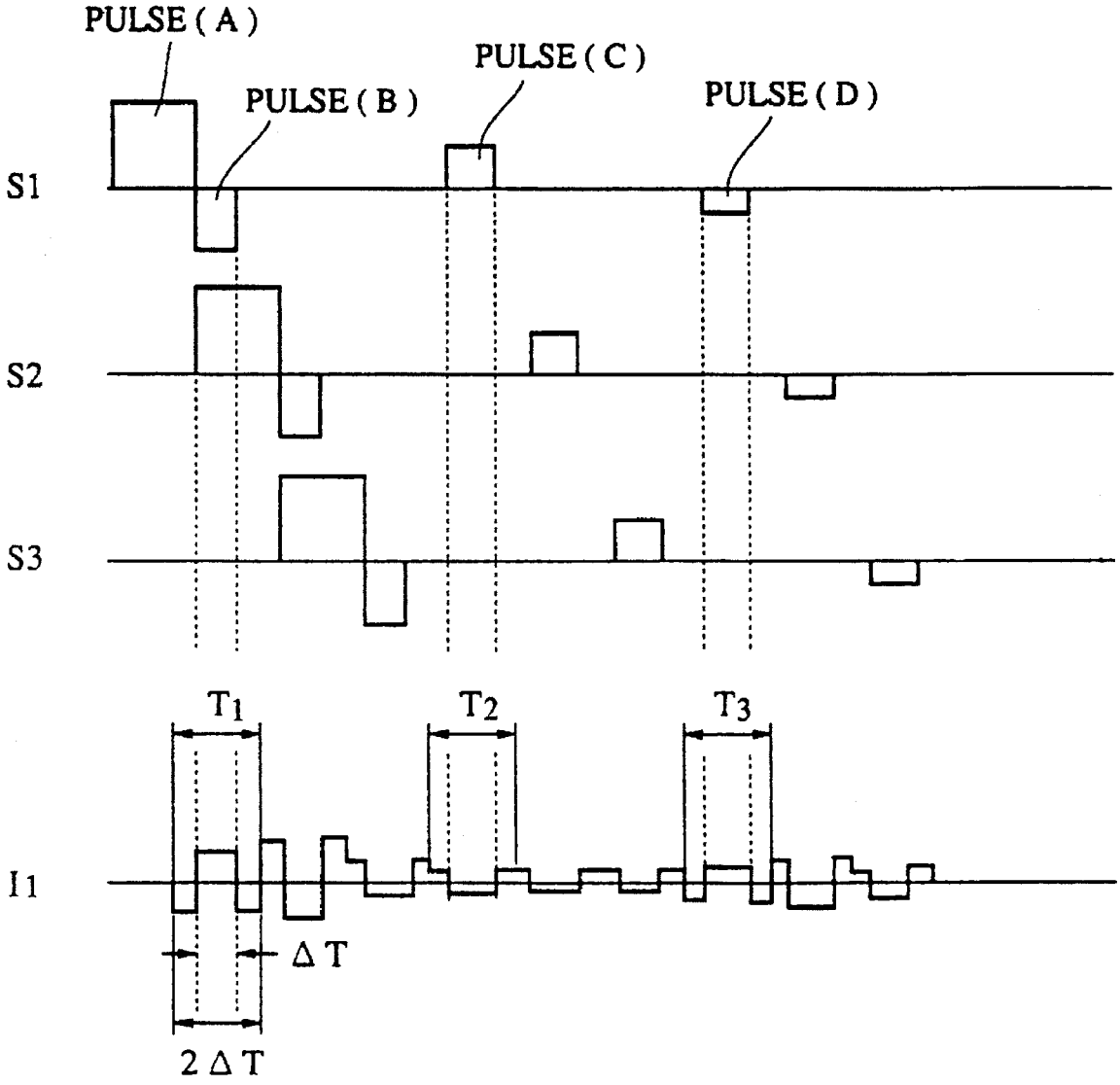
FIG. 5 PRIOR ART
FIG. 5 also illustrates the 4-pulse method.
Figure 6:
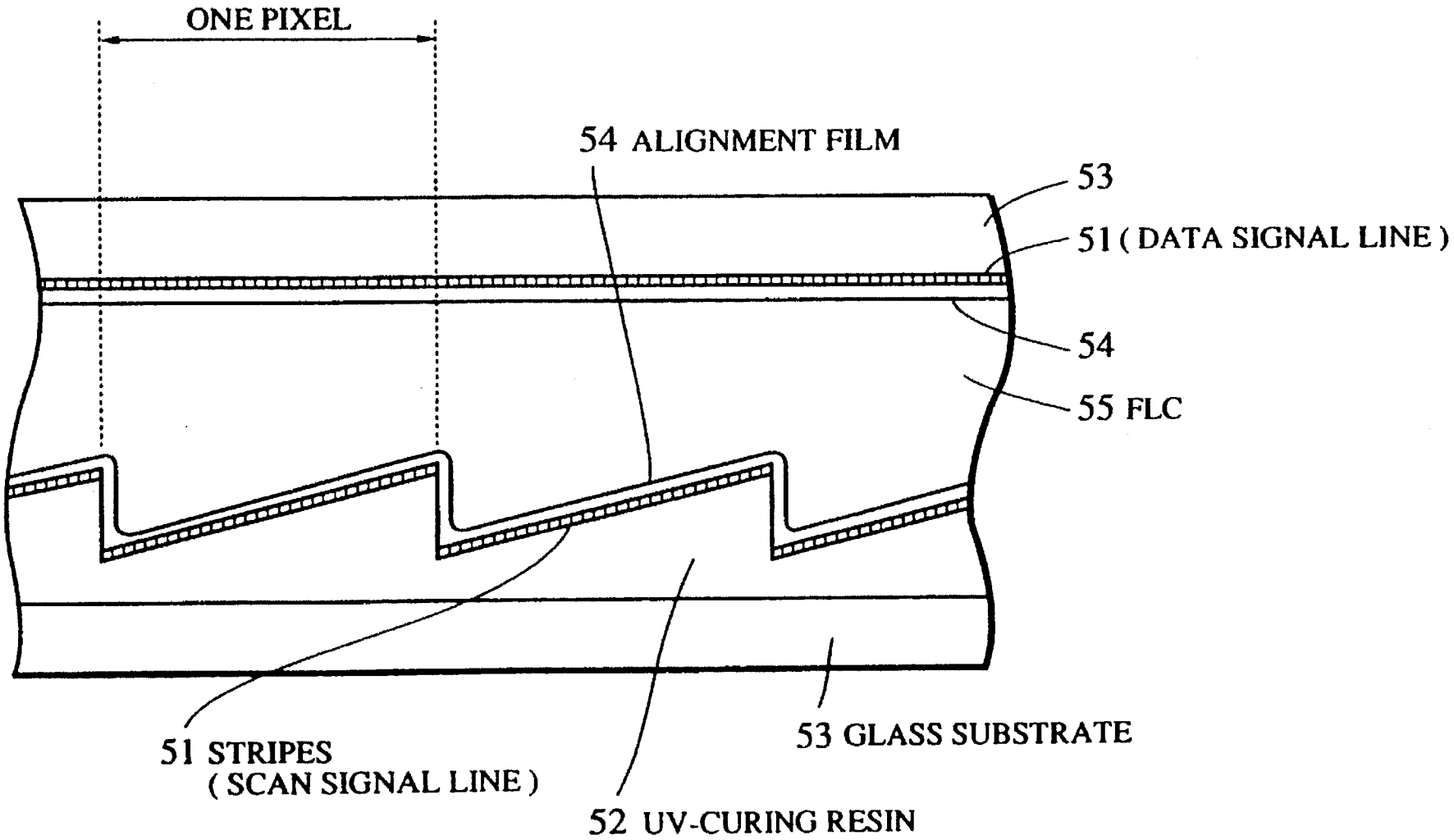
FIG. 6 PRIOR ART
FIG. 6 schematically illustrates an LC cell suitable for the LC display device of the present invention.
Figure 7A:
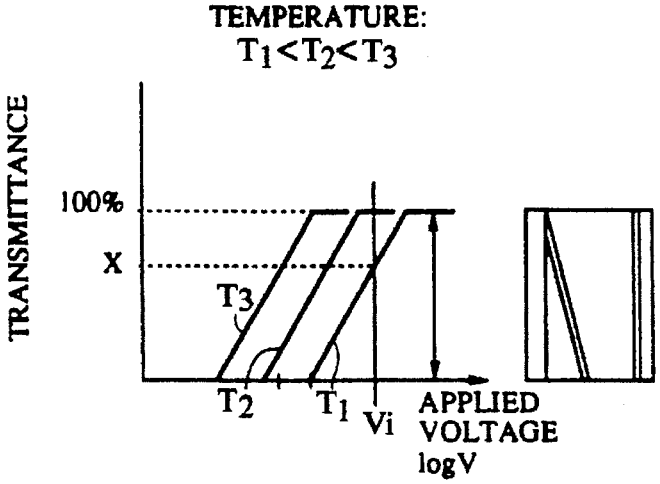
FIG. 7(a) PRIOR ART
FIGS. 7(*a*)–(*d*) illustrate the pixel shift method.
Figure 7C:
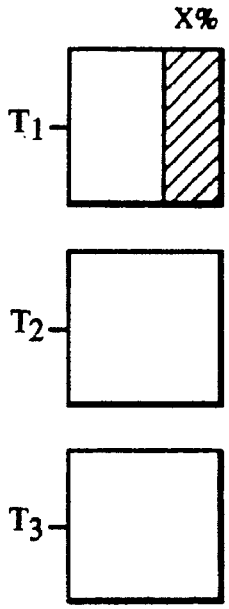
FIG. 7(c) PRIOR ART
Figure 7B:
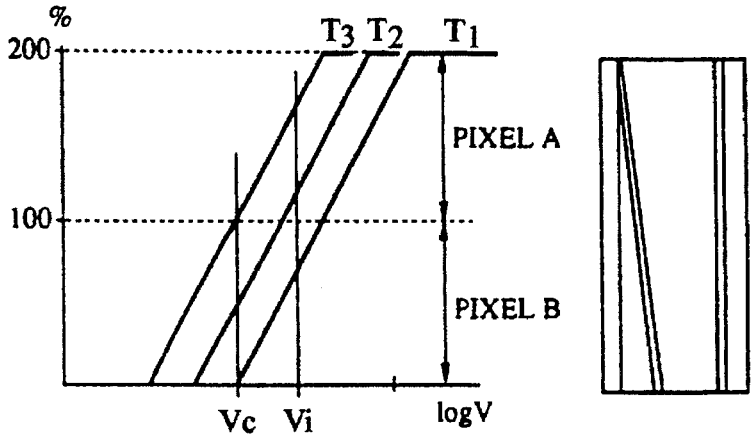
FIG. 7(b) PRIOR ART
Figure 7D:
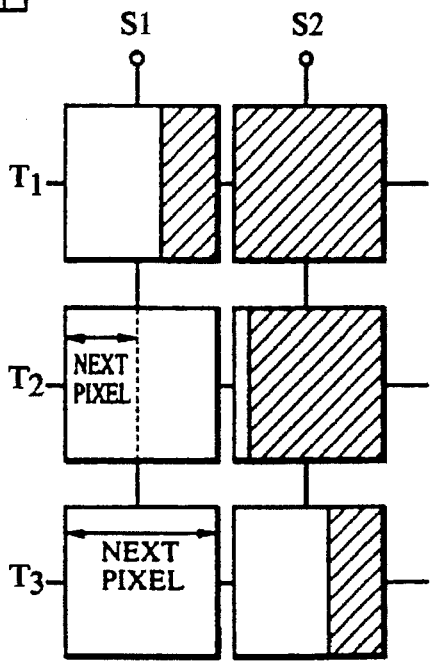
FIG. 7(d) PRIOR ART
Figure 8B:
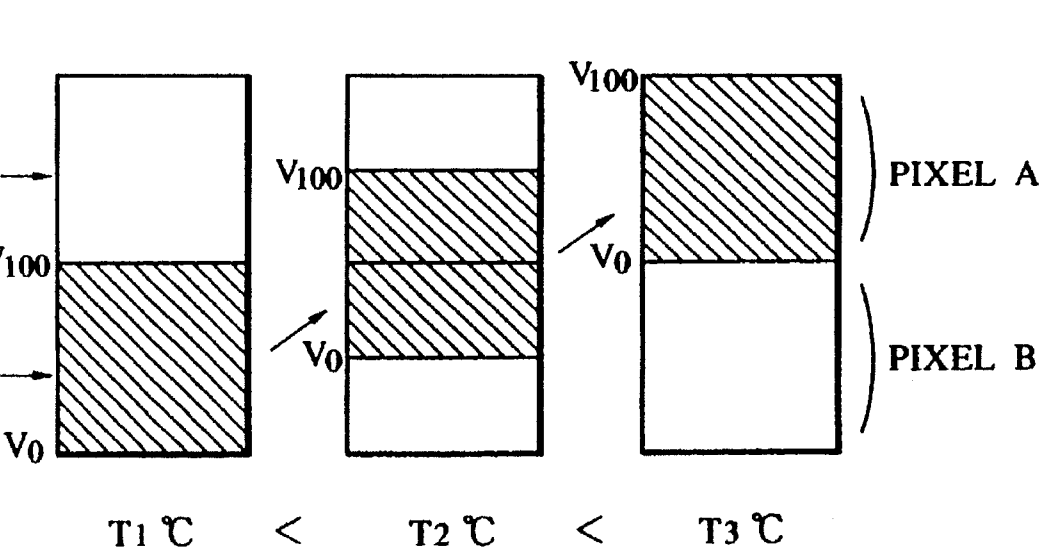
FIG. 8(b) PRIOR ART
FIGS. 8(*a*) and (*b*) also illustrate the pixel shift method.
Figure 8A:
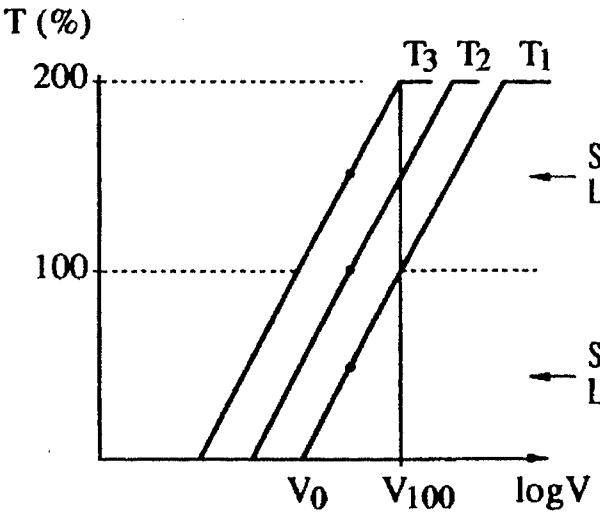
FIG. 8(a) PRIOR ART

Line 7, "FIG. 10" should read --FIG. 6--;
Line 20, "electrode 51." should read --electrodes 51.--;
Line 31, "inclines" should read --inclined--;
Line 32, "become" should read --becomes--;
Line 35, "rectangular" should read --rectangle--;
Line 60, "25" should be deleted.

COLUMN 11

Line 31, "|V1=20.0 V," should read --|V1|=20.0 V,--;
Line 41, "used" should read --uses--;
Line 48, "are" should be deleted.

UNITED STATES PATENT AND TRADEMARK OFFICE

CERTIFICATE OF CORRECTION

PATENT NO. : 5,657,038

DATED : August 12, 1997

INVENTOR(S): SHINJIRO OKADA ET AL.

It is certified that error appears in the above-identified patent and that said Letters Patent is hereby corrected as shown below:

COLUMN 12

Line 33, "write-in-signal," should read --write-in signal,--;

Line 54, "frame" should read --frame,--.

SHEET 2

"INTERMEDITATE" should read --INTERMEDIATE--.

Signed and Sealed this

Fourteenth Day of April, 1998

Bruce Lehman

*Attest:*

BRUCE LEHMAN

*Attesting Officer*

*Commissioner of Patents and Trademarks*